United States Patent [19]

Drysdale

[11] 4,364,539

[45] Dec. 21, 1982

[54] DIAMOND DRILL SKID PAD

[75] Inventor: Alcide Drysdale, Bathurst, Canada

[73] Assignee: Brunswick Mining and Smelting Corporation Limited, Bathurst, Canada

[21] Appl. No.: 90,753

[22] Filed: Nov. 2, 1979

[30] Foreign Application Priority Data

Nov. 23, 1978 [CA] Canada ..... 316788

[51] Int. Cl.[3] ..... F16M 13/00

[52] U.S. Cl. ..... 248/647; 211/60 S; 248/678

[58] Field of Search ..... 248/346, 461, 639, 646, 248/647, 661, 676, 678; 211/60 S

[56] References Cited

U.S. PATENT DOCUMENTS

| | | | |
|---|---|---|---|
| 1,380,123 | 5/1921 | Sullivan | 248/678 X |
| 2,134,243 | 10/1938 | Berger | 248/678 |
| 2,139,113 | 12/1938 | Cline et al. | 248/639 |
| 2,187,909 | 7/1940 | McGiffert | 248/678 |
| 2,517,510 | 8/1950 | Singer | 248/678 X |
| 2,817,304 | 12/1957 | Newcomer | 248/346 X |
| 3,637,070 | 1/1972 | Friedman | 248/461 X |

FOREIGN PATENT DOCUMENTS

| | | | |
|---|---|---|---|
| 673407 | 11/1963 | Canada | 248/647 |
| 85354 | 4/1955 | Norway | 248/661 |

*Primary Examiner*—William H. Schultz
*Attorney, Agent, or Firm*—Fleit & Jacobson

[57] ABSTRACT

A diamond drill skid pad is disclosed. The skid pad comprises at least two elongated skid members having relatively large ground engaging surfaces with upwardly curved ends for easy sliding of the skid pad on the ground surface, structural cross members for joining the skid members in spaced parallel relation and also forming a storage space for drill rods between the skid members, and means defining a trackway for a drill stand on the upper surface of the skid pad. A removable platform is preferably provided over the skid members for covering the storage space and supporting the drill operator and equipment.

5 Claims, 3 Drawing Figures

DIAMOND DRILL SKID PAD

This invention relates to a diamond drill skid pad. The changing of mining methods from longhole stoping to cut and fill has increased drift dimensions to the point where conventional diamond drill set-ups are no longer practical from both safety and operating aspects. It has been already proposed to mount diamond drills on movable skids, such as disclosed, for example, in Canadian Pat. No. 673,407 issued Nov. 5, 1963. However, the known skids are relatively small and can only support the drill itself.

It is therefore the object of the present invention to provide a larger skid pad which would allow the drill, the water pumps and all ancillary equipment including drill rods to be moved by a mobile equipment unit, completely assembled, from one location to another without the work of dismantling and re-assembling each time.

The drill skid pad, in accordance with the invention, comprises at least two elongated skid members having relatively large ground engaging surfaces preferably having upwardly curved ends for easy sliding of the skid pad on the ground surface, structural cross members for joining the skid members in spaced parallel relation and also forming a storage space for drill rods between the skid members, and means defining a trackway for a drill stand on the upper surface of the skid pad.

A removable platform is preferably provided on top of the skid pad for covering the storage space and supporting the drill operator and equipment.

The skid pad preferably comprises an additional elongated skid member positioned in close relation to one of the skid members so as to form the trackway for the drill stand.

The above structural cross members preferably include end members joining the ends of the skid members and additional transverse members joining two adjacent skid members and forming a base for supporting the drill rods.

The ends of the skid members on opposite side of the pad are preferably provided with hook engageable means for towing the skid pad from one location to the other.

The invention will now be disclosed, by way of example, with reference to a preferred embodiment illustrated in the accompanying drawings in which.

Figure 1:
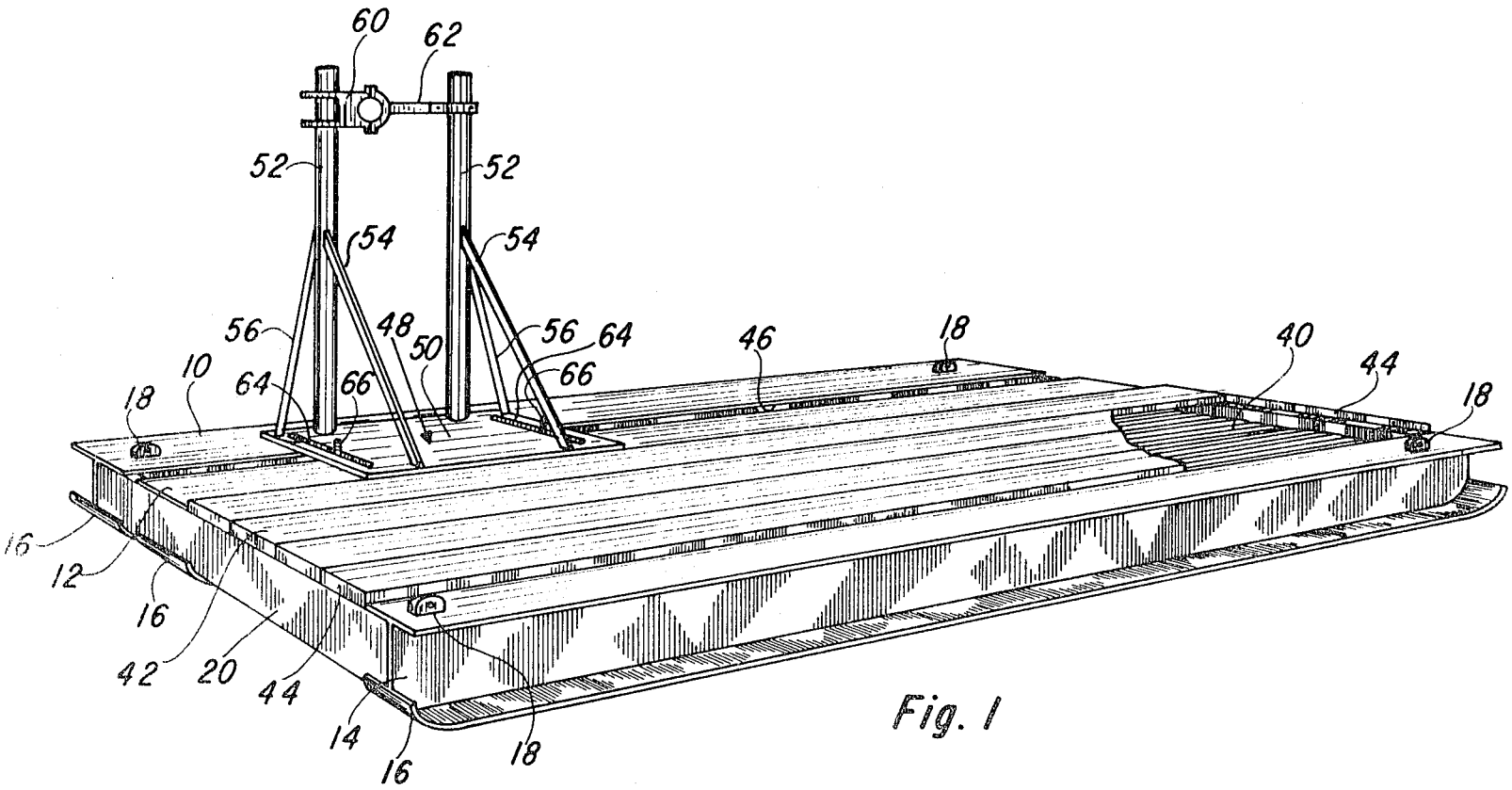
FIG. 1 is a perspective view of a diamond drill skid pad in accordance with the invention.
Figure 2:
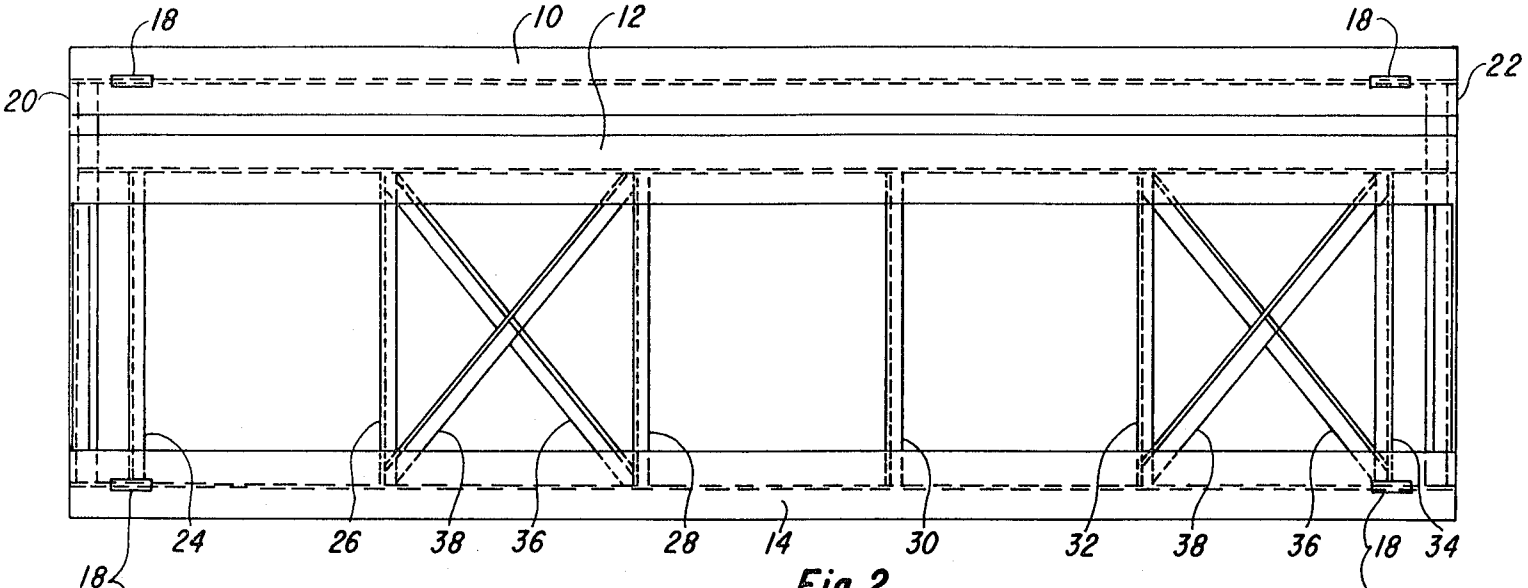
FIG. 2 is a plan view of the skid pad of FIG. 1.
Figure 3:
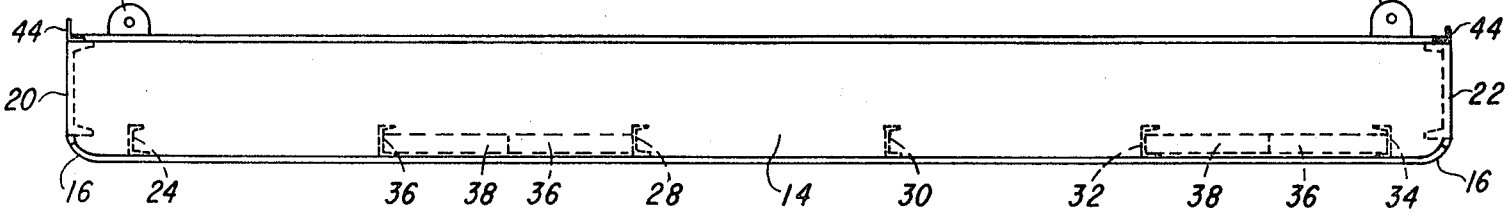
FIG. 3 is a sideview of the skid pad of FIG. 1.

Referring to FIGS. 1–3, there is shown a diamond drill skid pad comprising three elongated skid members 10, 12 and 14 in the form of I beams having relatively wide horizontal flat sections so as to form large ground engaging surfaces. The ground engaging section of each skid member is formed with an upwardly curved end portion 16 for permitting easy sliding of the skid pad on the ground. Ears 18 are also provided at the ends of each skid member 10 and 14 for connection to a hook to move the skid pad.

The skid members are held in spaced parallel relation by end beams 20 and 22 welded to the skid members 10, 12 and 14. Additional structural cross members 24, 26, 28, 30, 32 and 34 as well as bracing members 36 and 38 located between structural members 26 and 28 and between structural members 32 and 34, are welded between skid members 12 and 14 to join the skid members in spaced relation and also to form a base for storing drill rods 40. A platform 42 made of individual boards covers the storage space and also provides a standing surface for the drill operators and the equipment. The boards are prevented from sliding longitudinally by means of angular members 44 welded or otherwise secured to end members 20 and 22.

Skid members 10 and 12 are spaced a close distance apart so as to form a trackway 46 into which a drill stand 48 may slide along the full width of the skid pad. The drill stand consists of a base plate 50 upon which are welded or otherwise secured two drill mounting posts 52 braced vertically by brackets 54 and 56. The drill is held by a drill clamp 60 having one half secured to one mounting post and the other half secured to a spreader bar 62 which is itself secured to the other mounting post. The base plate 50 is provided with slots 64 into which are inserted bolts 66 for securing the plate 50 to the skid pad. Slots 64 permit transverse movement of the drill stand with respect to the skid pad in addition to its longitudinal movement.

The above disclosed skid pad is large enough to support the drill water pump as well as all the other ancillary equipment. Thus, when moving, disassembling of the equipment is no longer required. All that is needed is to disconnect air and water hoses, move to the new drill location, set the drill on line with a hole and reconnect the hoses. This eliminates much damage to the equipment during handling. In addition, when setting up, it is not necessary to have the skid in any particular position. The drill can be positioned easily because it is mounted on a movable stand on the skid. Drill rods are also readily available since they are stored in the skid pad itself.

Although the invention has been disclosed with reference to a particular embodiment, it is to be understood that various alternatives are envisaged and that the invention is to be limited in scope by the claims only. For example, only two skid members are required for making the pad and the trackway for mounting the drill stand on the upper surface of the skid pad may take other forms than the one illustrated in the drawing. Furthermore, any type of structural cross members for joining the two skid members in spaced parallel relation and for forming the storage space can be used.

What is claimed is:

1. A diamond drill skid pad comprising:

(a) at least two elongated skid members having relatively large ground engaging surfaces;

(b) structural cross members for joining said skid members in spaced parallel relation and also forming a storage space for drill rods between said skid members; and (c) an additional elongated skid member positioned in close relation to one of said elongated members so as to form a trackway for a drill stand on the upper surface of said skid pad.

2. A diamond drill skid as defined in claim 1, further comprising a removable platform for covering said storage space and for supporting the drill operator and equipment.

3. A diamond drill skid pad as defined in any one of claims 1 or 2, wherein said structural cross members include end members joining the ends of the skid members and additional transverse members joining two adjacent skid members and forming a base for supporting the drill rods.

4. A diamond drill skid pad as defined in claim 1, wherein said skid members are made of I beams.

5. A drill skid pad as defined in claim 1, further comprising hook engageable means secured to the ends of said skid members for towing the skid to the drilling site.

* * * * *